US007585019B2

(12) United States Patent
Huang et al.

(10) Patent No.: US 7,585,019 B2
(45) Date of Patent: Sep. 8, 2009

(54) SEAT RECLINING MECHANISM FOR POWER WHEELCHAIR

(75) Inventors: Alfred Huang, Taichung (TW); Shun-Yuan Chu, Taichung (TW)

(73) Assignee: Cycling & Health Tech Industry R & D Center, Taichung (TW)

( * ) Notice: Subject to any disclaimer, the term of this patent is extended or adjusted under 35 U.S.C. 154(b) by 286 days.

(21) Appl. No.: 11/633,607

(22) Filed: Dec. 4, 2006

(65) Prior Publication Data

US 2008/0129099 A1 Jun. 5, 2008

(51) Int. Cl.
*A61G 5/00* (2006.01)

(52) U.S. Cl. ..... 297/86; 297/342; 297/411.39; 297/DIG. 4

(58) Field of Classification Search ..... 297/68, 297/78, 83, 84, 85, 86, 87, 322, 340, 342, 297/411.39, 353, DIG. 4
See application file for complete search history.

(56) References Cited

U.S. PATENT DOCUMENTS 4,285,541 A * 8/1981 Onishi ..... 297/84
4,339,013 A * 7/1982 Weigt ..... 180/6.5
4,492,407 A * 1/1985 Broadhead ..... 297/78
4,614,246 A * 9/1986 Masse et al. ..... 180/6.5
4,691,962 A * 9/1987 Holdt ..... 297/84
5,154,438 A * 10/1992 Barclay ..... 280/250.1
5,181,762 A * 1/1993 Beumer ..... 297/358
6,032,976 A * 3/2000 Dickie et al. ..... 280/650
6,412,870 B1 * 7/2002 Higgins et al. ..... 297/342
6,916,069 B2 * 7/2005 Bauer et al. ..... 297/423.3
7,025,415 B1 * 4/2006 Wu ..... 297/119

* cited by examiner

*Primary Examiner*—David Dunn
*Assistant Examiner*—Patrick Lynch
(74) *Attorney, Agent, or Firm*—Charles E. Baxley

(57) ABSTRACT

A seat reclining mechanism for a power wheelchair implements an actuator and a plurality of linkages mechanistically connected to the seat portion, back portion, arm rests and footrests of the wheelchair to recline the back portion and shift the seat in harmony with the center-of-gravity position of the wheelchair it is attached to synchronously. So that a user can be free from the risk of falling during operation of the seat reclining mechanism.

6 Claims, 11 Drawing Sheets

SEAT RECLINING MECHANISM FOR POWER WHEELCHAIR

BACKGROUND OF THE INVENTION

1. Technical Field

The present invention relates to seats of power wheelchairs, and more particularly, to a seat reclining mechanism for a power wheelchair.

2. Description of Related Art

Power wheelchairs, such as electric wheelchairs or motorized wheelchairs are mobility assistive devices commonly provided to disabled people or bed-bound patients for allowing them to move self-reliantly. Thus, good adaptability and maneuverability are obviously important in wheelchairs. For meeting such need, some wheelchairs may be equipped with reclining chairs for providing the users with comfortable and convenient usage.

As everyone knows, a chair is basically composed of a seat portion and a back portion, which is settled roughly perpendicular to the seat portion. A pair of arm rests and footrests may be also attached for the user's comfort. Further, the seat is preferable to possess position angle variability for providing convenience to the user for his movement between the wheelchair and a bed under or without others' assistance. Thus, it is desirable that a seat of a wheelchair can be reclined into a flat shape. To form such flat shape, the back portion has to perform a pivot motion with about a 90-degree pivot angle and the arm rests as well as footrests have to move toward an altitude approximately close to the seat.

Since the center-of-gravity position of a human body can consequently shift from hips toward the lumbar and back regions during reclining, person sitting on a reclining chair designed without consideration of gravity adjustment may fall down therefrom during operation of the reclining mechanism. Thus, a need exists for a seat reclining mechanism, which is capable of reclining the back portion and shifting the seat portion thereof in harmony with the center-of-gravity position of the wheelchair it is attached to synchronously.

SUMMARY OF THE INVENTION

The present invention has been accomplished under the circumstances in view and provides a seat reclining mechanism comprising an actuator and a plurality of linkages mechanistically connected mutually.

It is one object of the present invention to provide a seat reclining mechanism for a power wheelchair which can be adjusted from an initial seat position to a reclined flat position to provide a horizontal carrying surface for facilitating a user's riding or alighting from the wheelchair.

It is another object of the present invention to provide a seat reclining mechanism for a power wheelchair, which keeps the center-of-gravity positions of both the wheelchair user and the wheelchair coincided through the reclining motions thereof, so that a safe and steady change of posture of the wheelchair user can be ensured.

It is still another object of the present invention to provide a seat reclining mechanism for a power wheelchair which accomplishes a smooth seat-reclining movement by implementing a single actuator and an ingenious linkage system with small costs and mechanical loading.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

Figure 1:
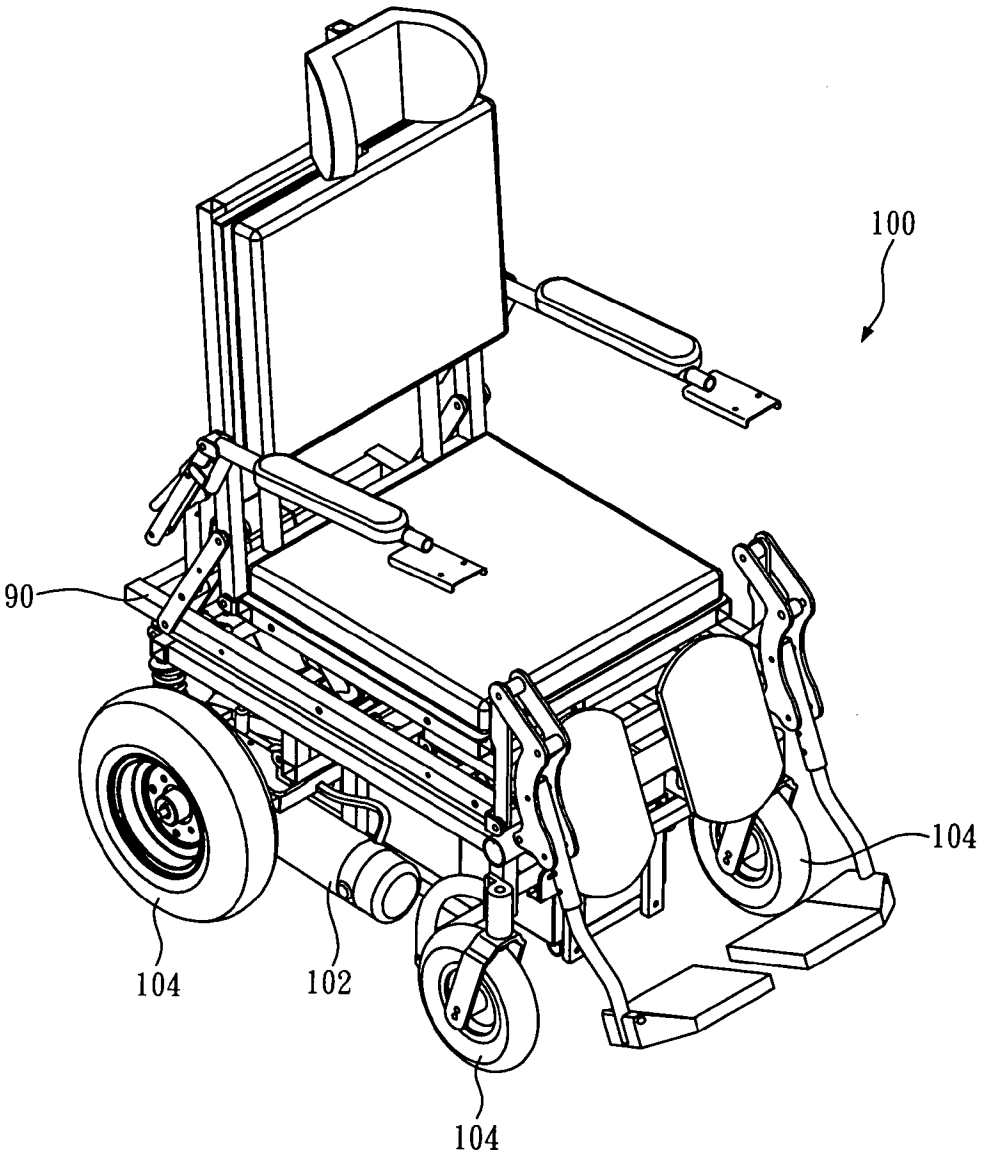
FIG. 1 is a perspective view of a seat reclining mechanism assembled with a power wheelchair according to the present invention.
Figure 2:
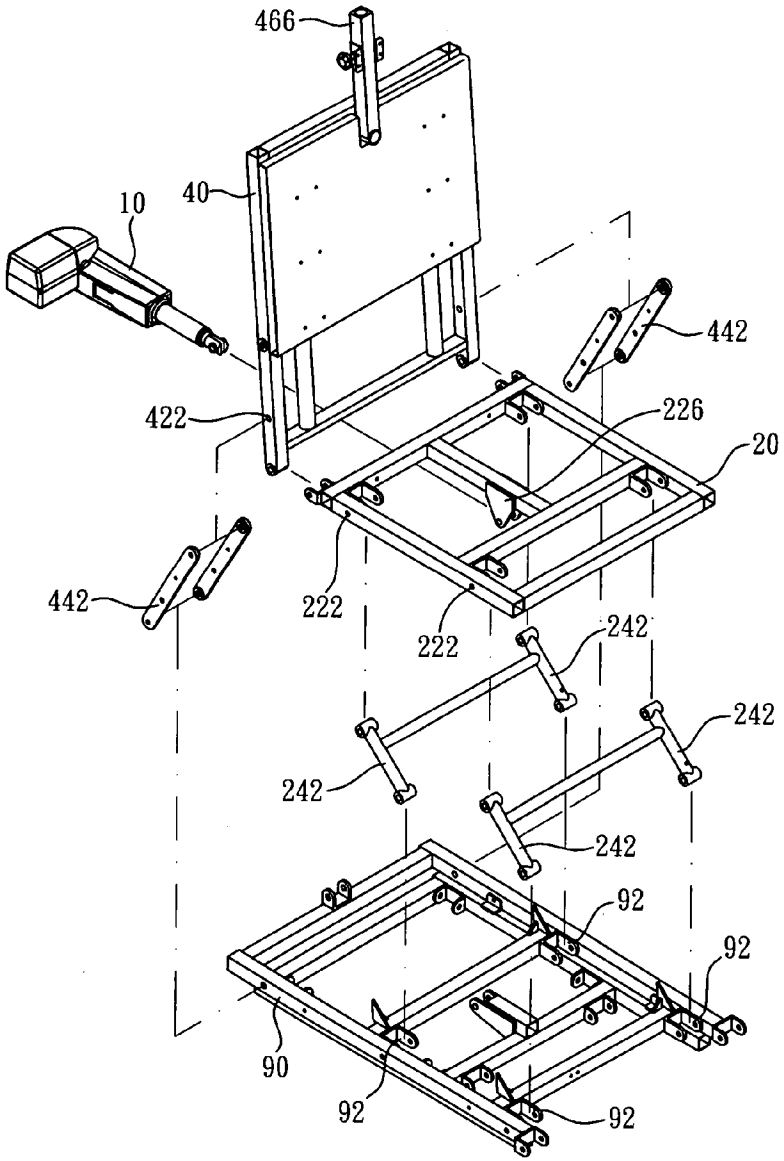
FIG. 2 is an exploded view illustrating the fabrication of the stationary bracket, seat frame and back frame of the disclosed seat reclining mechanism.
Figure 3:
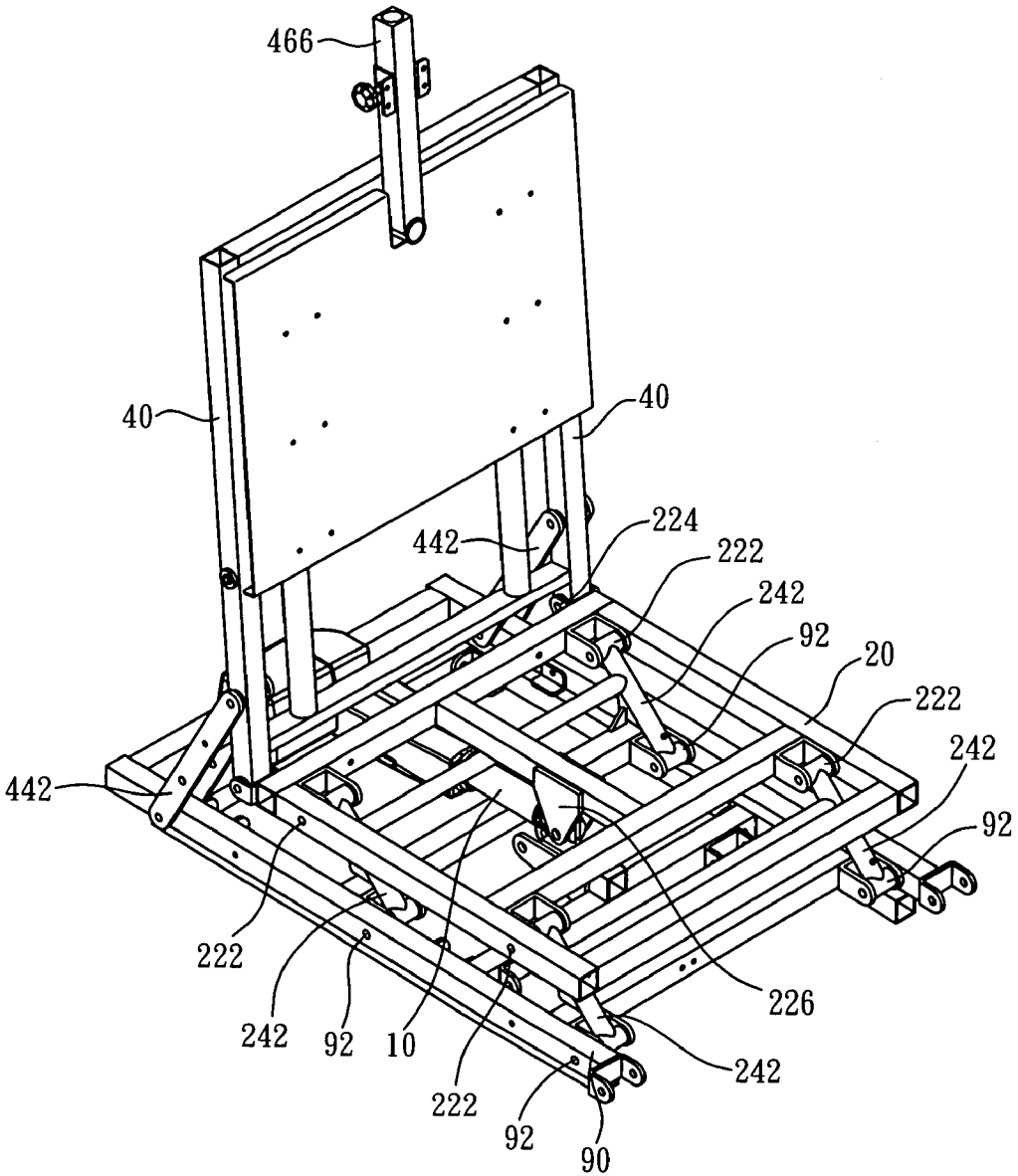
FIG. 3 is an assembly drawing depicting the fabrication of the stationary bracket, seat frame and back frame of the disclosed seat reclining mechanism.
Figure 4:
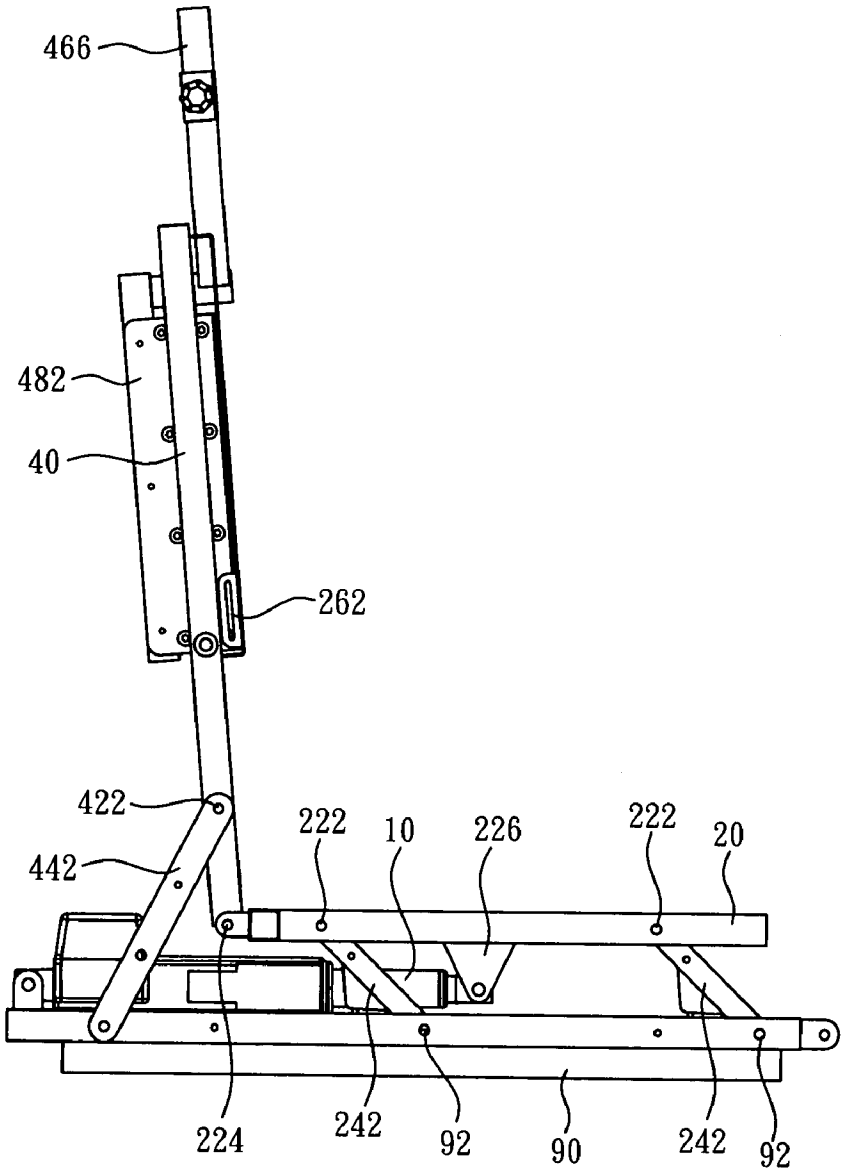
FIG. 4 is a lateral view depicting the stationary bracket, seat frame and back frame of the disclosed seat reclining mechanism at an initial seat position.

According to a concept of the present invention, the disclosed seat reclining mechanism can be applied to a mobility assistive device, such as a power wheelchair 100. As shown in FIG. 1, according to one embodiment of the present invention, a power wheelchair 100 may include a power source 102, a plurality of wheels 104 and a stationary bracket 90 mounted onto the wheels 104 and functioning as a chassis whereon the disclosed seat reclining mechanism is installed, wherein the seat reclining mechanism primarily comprises an actuator 10, a seat frame 20, and a back frame 40. The structural relationship among the stationary bracket 90, seat frame 20, and the back frame 40, as shown in FIGS. 2, 3 and 4, will be explained below.

The orientation related to the seat reclining mechanism is firstly defined for further description. In following description, alleged front is referred to an end thereof corresponding to the actuating direction of the actuator 10, while the opposite end is defined as the rear.

The details of the seat reclining mechanism according to the present invention are to be elaborated in the following description. First, four junction points 92 on the stationary bracket 90 and four junction points 222 on the bottom of the seat frame 20 are arranged correspondingly and between each pair of the corresponding junction points 92, 222, a first bracket link 242 is provided to hold the seat frame 20 above the stationary bracket 90.

The back frame 40 is pivotably arranged at the rear end of the seat frame 20 and has a pair of junction points 422 positioned respectively at the lower ends of both sides thereof. To link up the stationary bracket 90 with each junction point 422 of the back frame 40, a second bracket link 442 is provided therebetween.

A connecting portion 226 is extended form the central bottom of the seat frame 20 and drivably connected to the actuator 10.

Through foresaid structure, when the seat reclining mechanism is at its initial seat position, as shown in FIG. 4, the seat frame 20 and back frame 40 are approximately perpendicular to each other, and the four junction points 222 of the seat frame 20 are at the rear top of the four junction points 92 of stationary bracket 90 correspondingly. At this point, each first bracket link 242 is reclined with respect to the relevant junction point 92 on the stationary bracket 90.

When the actuator 10 is started, the connecting portion 226 at the bottom of the seat frame 20 is pushed forward and renders the four first bracket links 242 oscillating forward synchronously. Such oscillations in turn cause the seat frame 20 to move forward smoothly and stably and stop at a predetermined advanced position. At this point, each first bracket link 242 is reclined with respect to the relevant junction point 92 on the stationary bracket 90.

Figure 5:
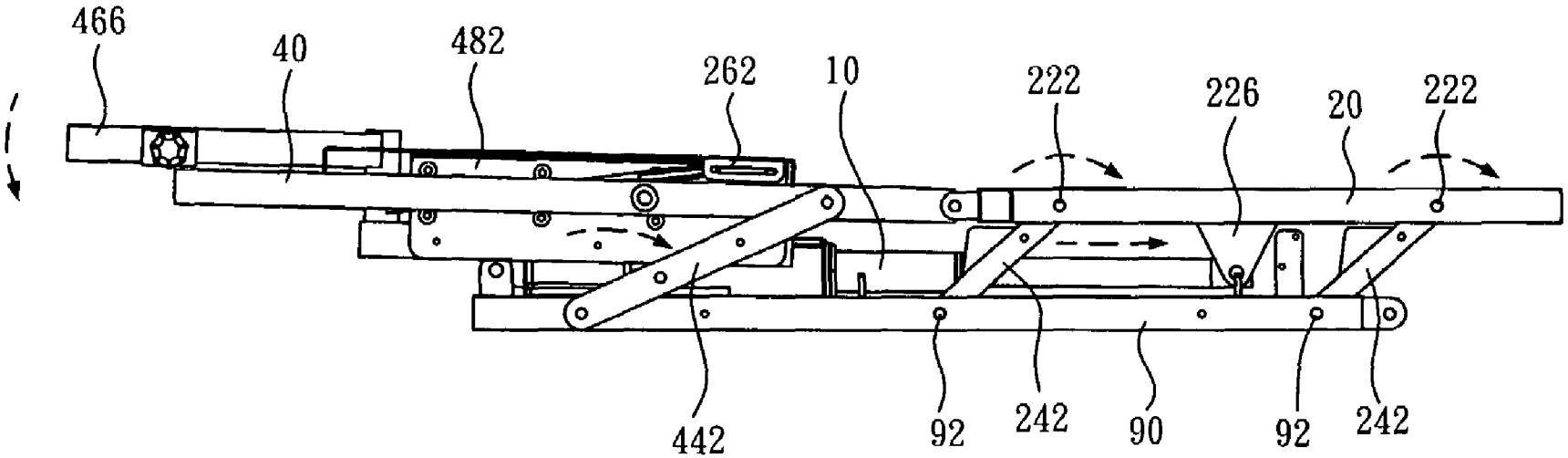
FIG. 5 is a lateral view depicting the stationary bracket, seat frame and back frame of the disclosed seat reclining mechanism at a reclined flat position.

As the seat frame 20 is pushed forward, the back frame 40 that is mounted at the rear end thereof is pulled forward proceedingly. Since the back frame 40 is further fastened to the stationary bracket 90 by the second bracket links 442, it is restrained from moving forward vertically and pulled to recline gradually along moving forward. Eventually, the back frame 40 is brought into a level position, as shown in FIG. 5.

Figure 6:
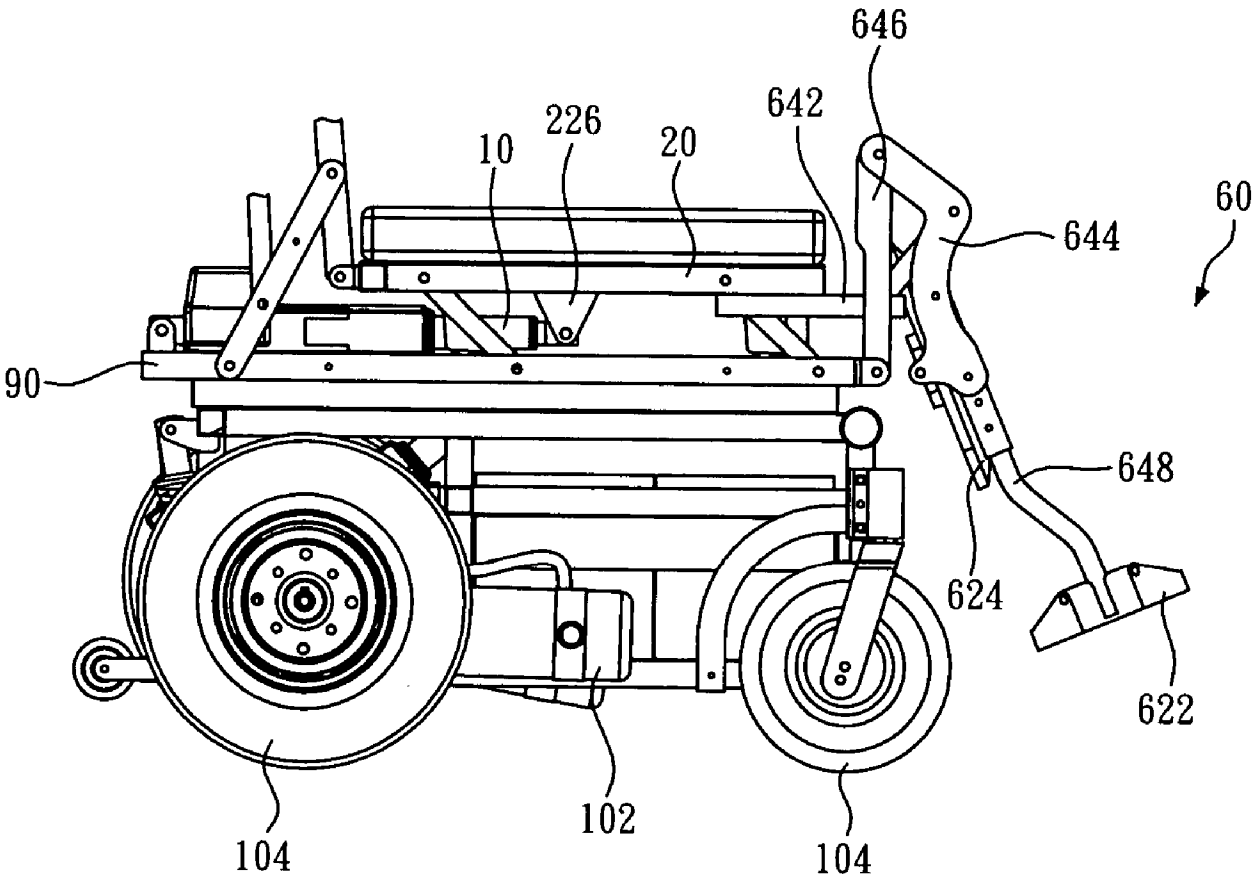
FIG. 6 is an assembly drawing depicting the fabrication of the stationary bracket and leg support linkage of the disclosed seat reclining mechanism.

The disclosed seat reclining mechanism still comprises a pair of leg support linkages 60, as shown in FIG. 6, each having a footrest 622, a leg rests 624 and a linkage system wherein the linkage system includes a third bracket link 646 having one end pivotly connected to the stationary bracket 90 and the other end pivotly connected to one end of an intermediate link 644, of which the other end is immovably affixed by the leg rest 624 as well as the footrest 622 and a bent link arm 642 fastened to the seat frame 20 and the middle portion of the intermediate link 644 at both ends thereof respectively.

According to foregoing structure, when the seat reclining mechanism is at its initial seat position, the third bracket links 646 are approximately perpendicular to the stationary bracket 90, and the intermediate links 644 are also positioned approximately perpendicular to the stationary bracket 90 so that the footrest bars 648 as well as the footrests 622 are consequently oriented toward the ground.

Figure 7:
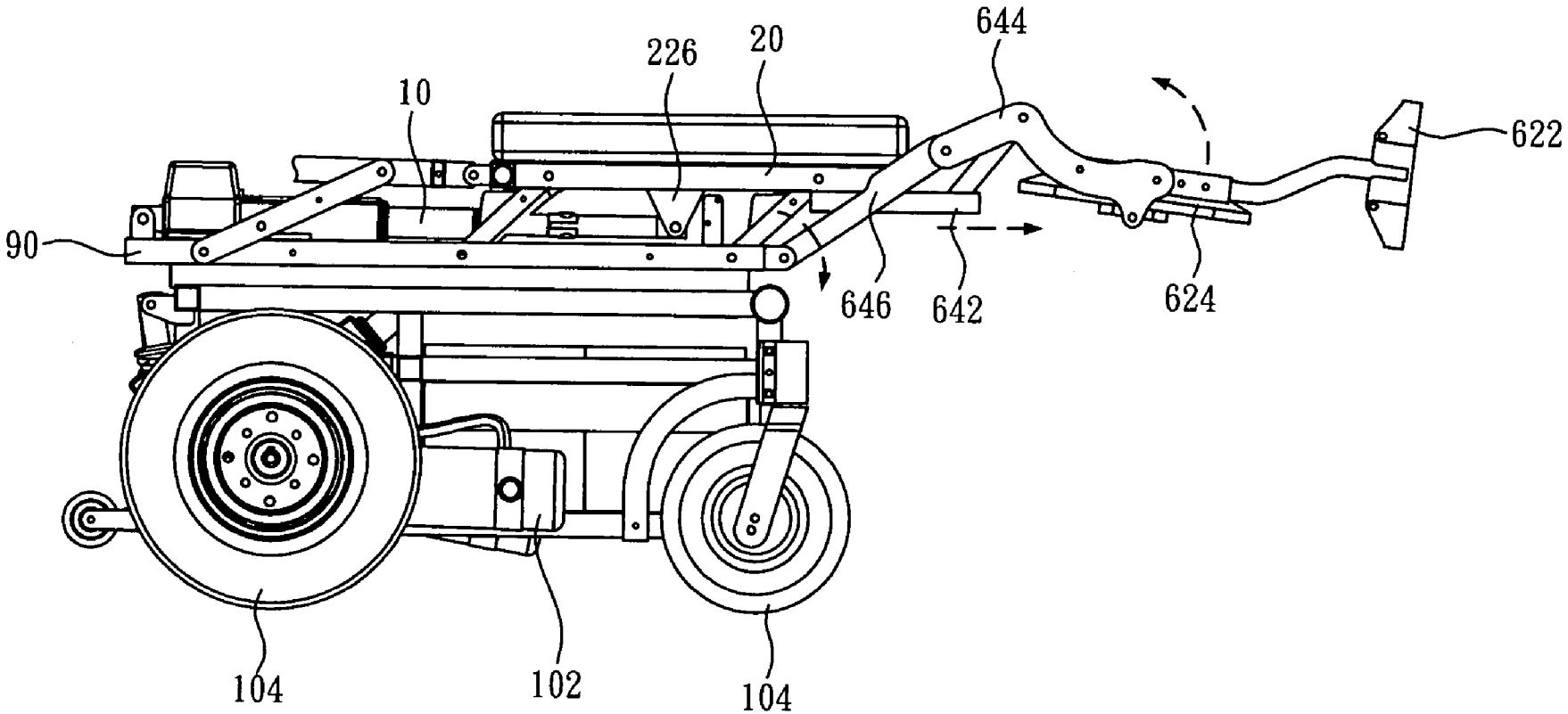
FIG. 7 is an applied view showing the link motion of the leg support linkage with regard to the stationary bracket according to the disclosed seat reclining mechanism.

When the actuator 10 is started, the seat frame 20 is pushed forward as previously discussed and in turn presses the bent link arm 642 forward to give an impetus to the intermediate link 644. At this point, the advancement of the intermediate link 644 lifts up the third bracket link 646 which is further fastened to the stationary bracket 90 and cause the intermediate link 644 to pivot on the bent link arm 642 and stop at an approximate level position. Thereby, the third bracket links 646, the intermediate link 644, leg rest 624 as well as the footrest 622 are relatively spread in a horizontal direction, as shown in FIG. 7.

Figure 8:
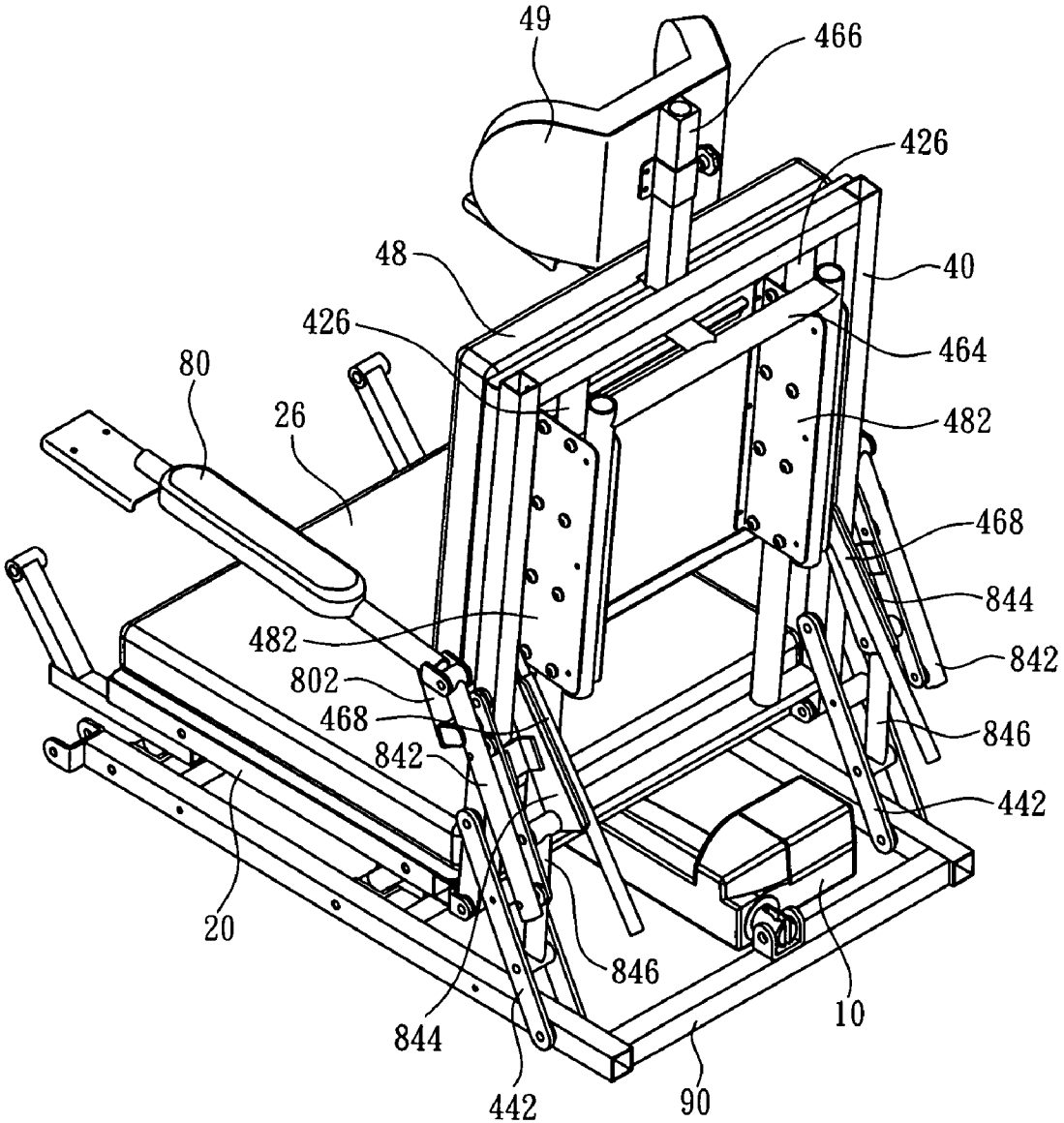
FIG. 8 is an assembly drawing depicting the fabrication of the stationary bracket, back frame and back cushion of the disclosed seat reclining mechanism.
Figure 9:
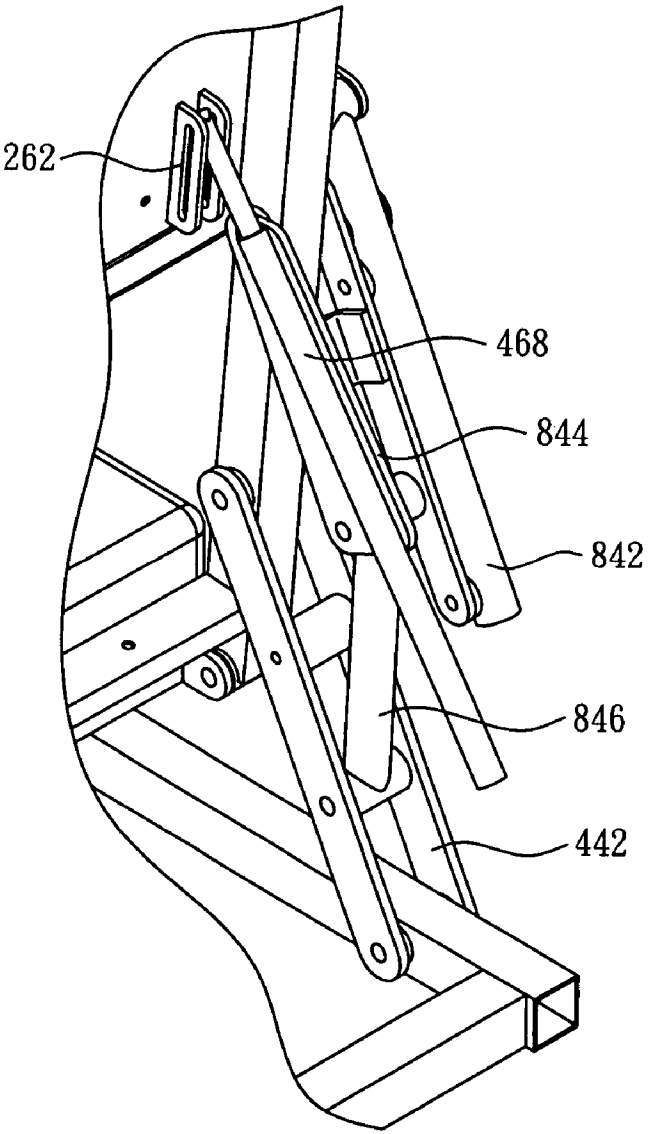
FIG. 9 is an enlarged drawing describing partial assembly according to FIG. 8.

Also, referring to FIGS. 8 and 9, a pair of armrests 80 may be provided to the disclosed mechanism, wherein each armrest 80 has one end connected with a linkage system which comprises an armrest link 842, a back frame link 844, and an intermediate link 846. Specifically, the back frame link 844 is pivotally connected to the back frame 40; the armrest link 842 is attached to the outer side of the back frame link 844; and the intermediate link 846 has one end pivotally connected to the back frame link 844 while has the other end pivotally connected to the second bracket link 442 provided between the stationary bracket 90 and the back frame 40. Further, each the armrest 80 has an L-shaped crutch 802 extended therefrom before the armrest link 842 for propping the armrest link 842 from pivoting downward.

Through said structure, when the disclosed seat reclining mechanism is at its initial seat position, the armrests 80 can be propped up by the L-shaped crutch 802 and maintained at a position horizontal to the seat frame 20, as shown in FIG. 8. Accordingly, when the actuator 10 is started, the back frame 40 and second bracket links 442 are pulled forward as described above, and such movements in turn cause the intermediate links 846 reclining to bring the armrests 80 descending toward the seat frame 20.

Furthermore, a seat cushion 26 may be fixed to the seat frame 20 while a back cushion 48 is slidably attached to the back frame 40. As can be seen in FIGS. 7, 8 and 9, the back cushion 48 is installed so as to automatically shift along the back frame 40 according to the reclining motion of the disclosed mechanism by means of a sliding device.

For achieving above shifting motion of the back cushion 48, according to the present embodiment, the back cushion 48 having a height smaller than that of the back frame 40 includes two sets of clamping pieces 482 for holding a pair of vertical bars 426 provided on the back frame 40, a reversed U-shaped frame 464 having a height similar to that of the back cushion 48 which is fixedly attached to the clamping pieces 482 beyond the vertical bars 426 and a pair of elongated guide slots 262 are provided at the lower back side of the back cushion 48 to receive a pair of extensible rods 468 each having a sleeve part fixed to the inner side of each back frame link 844 and thus the back cushion 48 with the sliding device is accomplished. In addition, the reversed U-shaped frame 464 may comprise a headrest holder 466 whereon a headrest 49 can be mounted in an adjustable way.

By the disclosed structure, when the seat reclining mechanism of the present invention is at the initial seat position, as the extensible rod 468 is now retracted, the back cushion 48 can be positioned at the upper portion of the back frame 40. When the actuator 10 is started, as the back frame 40 and back frame links 844 are pulled to move as previously described, the extensible rod 468 is therefore inclined and elongated to push the back cushion 48 to shift forward along the reclining back frame 40. Thus, when the seat reclining mechanism finally comes to the reclined flat position, the distance between the seat cushion 26 and the back cushion 48 as well as the headrest 49 are closer than the distance therebetween at the initial seat position so as to respond to the changes of the positions of a user's head and back when he has a posture change from setting to laying.

Figure 10:
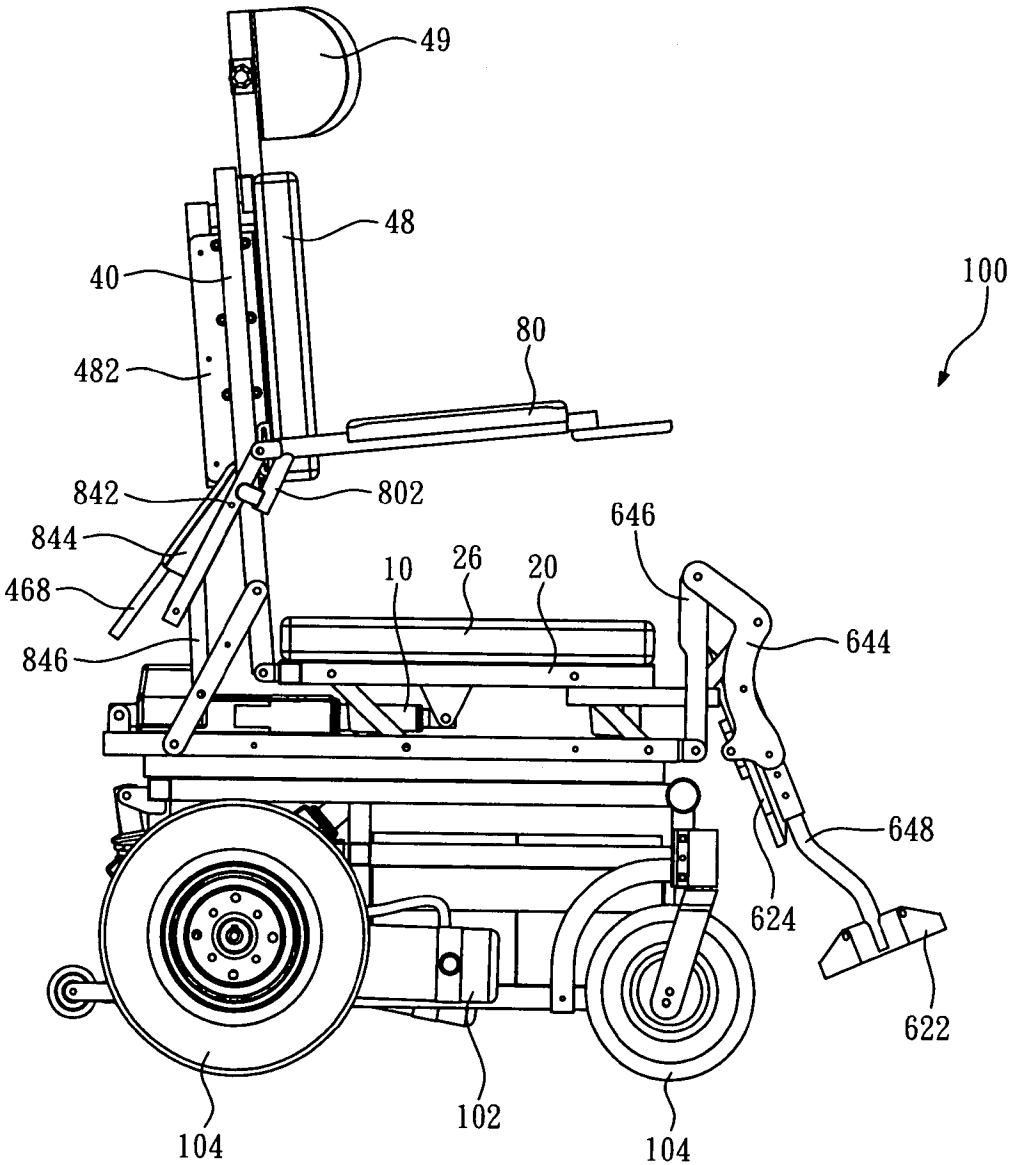
FIG. 10 is a lateral view depicting the disclosed seat reclining mechanism at the initial seat position.

According to the presently discussed embodiment, a power wheelchair equipped with the disclosed seat reclining mechanism can be seen at the initial seat position in FIG. 10. When the actuator 10 is started, a user sitting on the wheelchair has a posture change from setting to laying gradually while the center of gravity of the body is shifting from the hips toward the lumbar and back regions. At this time, since the seat cushion 26 fixed on the seat frame 20 moves forward under the operation of the seat reclining mechanism, the user's center of gravity of the body can keep reduplicated to the center of gravity of the wheelchair 100 throughout the reclining movement. Further, due to the ingenious linkage system, the disclosed seat reclining mechanism can achieve a reliable and approximately horizontal carrying surface through moving the seat cushion 26 forward, drawing the back cushion 48 and head rest 49 toward the seat cushion 26, lifting and extending the leg rests 624 and footrests 622 to an altitude similar to the seat cushion 26 and descending the armrests 80 to a position close to the seat cushion 26 by efficiently implementing the only actuator 10.

Figure 11:
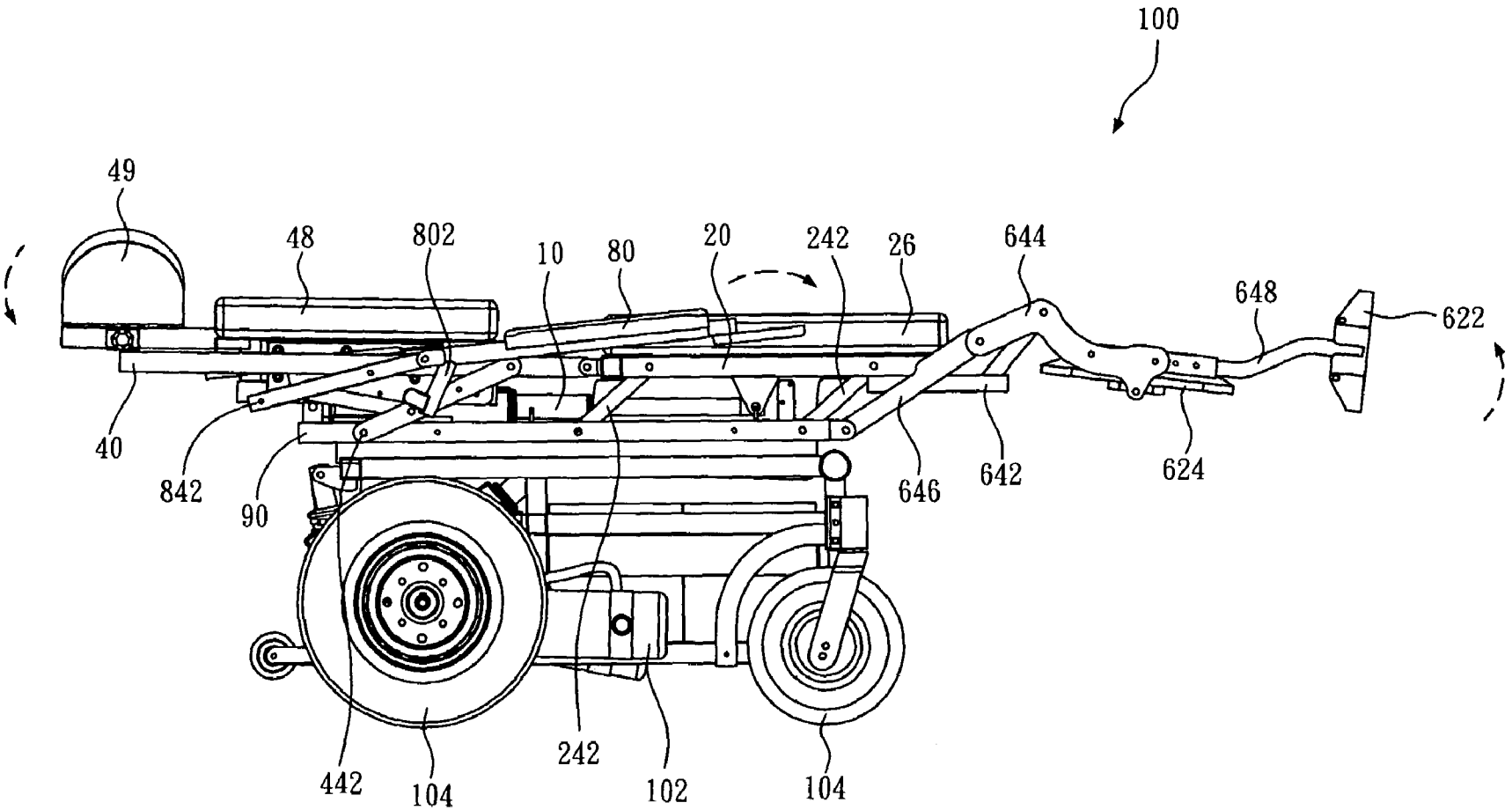
FIG. 11 is a lateral view depicting the disclosed seat reclining mechanism at the reclined flat position.

Whereas, when the actuator 10 is operated reversely, the seat reclining mechanism has all the components driven to move reversely according to foresaid motions and returns to the initial seat position from the reclined position as shown in FIG. 11.

Although a particular embodiment of the invention has been described in detail for purposes of illustration, it will be understood by one of ordinary skill in the art that numerous variations will be possible to the disclosed embodiments without going outside the scope of the invention as disclosed in the claims.

What is claimed is:

1. A seat reclining mechanism for being assembled to a stationary bracket of a wheelchair, the seat reclining mechanism primarily comprises:

a seat frame positioned above the stationary bracket by a plurality of first bracket links arranged between the seat frame and stationary bracket;

a back frame pivotally fastened to the rear end of the seat frame and connected to the stationary bracket with a pair of second bracket links; and an actuator drivably connected with the seat frame; whereby throughout a reclining movement of the seat reclining mechanism the plurality of first bracket links are pushed to oscillate forward gradually to keep the center of gravity of a user's body reduplicated to the center of gravity of the wheelchair; said seat reclining mechanism further comprising at least one leg support linkage which is composed of a footrest, leg rest and a linkage system; wherein the linkage system can be driven by the actuator to change the extending direction of the footrest and the leg rest; wherein the linkage system includes a third bracket link having one end pivotally connected to the stationary bracket and the other end pivotally connected to one end of an intermediate link, the other end of which is immovably affixed by the leg rest as well as the footrest, and a bent link arm fastened to the seat frame and the middle portion of the intermediate link at both ends thereof respectively.

2. The seat reclining mechanism as claimed in claim 1 wherein a back cushion having a height smaller than that of the back frame and a sliding device are provided on the back frame wherein the sliding device can be driven by the actuator to make the back cushion shift along the back frame.

3. The seat reclining mechanism as claimed in claim 1 wherein the actuator is a linear actuator.

4. A seat reclining mechanism for being assembled to a stationary bracket of a wheelchair, the seat reclining mechanism primarily comprising:

a seat frame positioned above the stationary bracket by a plurality of first bracket links arranged between the seat frame and stationary bracket;

a back frame pivotally fastened to the rear end of the seat frame and connected to the stationary bracket with a pair of second bracket links; and an actuator drivably connected with the seat frame; whereby throughout a reclining movement of the seat reclining mechanism the plurality first bracket links are pushed to oscillate forward gradually to keep the center of gravity of a user's body reduplicated to the center of gravity of the wheelchair; said seat reclining mechanism further comprising at least one armrest which is connected with a linkage system that can be driven by the actuator to change the altitude of the armrest with respect to the seat frame; wherein the linkage system comprises an armrest link, a back frame link, an intermediate link and an L-shaped crutch; wherein the back frame link is pivotally connected to the back frame; the armrest link is attached to the outer side of the back frame link; the intermediate link has one end pivotally connected to the back frame link and another end pivotally connected to one of the second bracket links provided between the stationary bracket and the back frame; and the armrest is propped by the L-shaped crutch which extends from the armrest link.

5. A seat reclining mechanism for being assembled to a stationary bracket of a wheelchair which primarily comprises:

a seat frame positioned above the stationary bracket by a plurality of first bracket links arranged between the seat frame and stationary bracket;

a back frame pivotally fastened to the rear end of the seat frame and connected to the stationary bracket with a pair of second bracket links; and an actuator drivably connected with the seat frame; whereby throughout a reclining movement of the seat reclining mechanism the plurality of first bracket links are pushed to oscillate forward gradually to keep the center of gravity of the wheelchair; wherein a back cushion having a height smaller than that of the back frame and a sliding device are provided on the back frame; wherein the sliding device can be driven by the actuator to make the back cushion shift along the back frame; wherein the sliding device comprises a plurality of back frame links, two sets of clamping pieces for holding a pair of vertical bars provided on the back frame, a reversed U-shaped frame having a height similar to that of the back cushion which is fixedly attached to the clamping pieces beyond the vertical bars and a pair of elongated guide slots are provided at the lower back side of the back cushion to receive a pair of extensible rods each having a sleeve part fixed to the inner side of each back frame link.

6. The seat reclining mechanism as claimed in them 5 wherein the reversed U-shaped frame comprises a headrest holder whereon a headrest is mounted in an adjustable way.

* * * * *